US012383946B2

(12) United States Patent
Kothari et al.

(10) Patent No.: US 12,383,946 B2
(45) Date of Patent: Aug. 12, 2025

(54) MANUFACTURING ZINC WIRE

(71) Applicants: Sanjana Kothari, Maharashtra (IN); Vishal Kothari, Maharashtra (IN)

(72) Inventors: Sanjana Kothari, Pune (IN); Vishal Kothari, Pune (IN); Nilesh Patil, Pune (IN)

(73) Assignees: Sanjana Kothari, Pune (IN); Vishal Kothari, Pune (IN)

( * ) Notice: Subject to any disclaimer, the term of this patent is extended or adjusted under 35 U.S.C. 154(b) by 0 days.

(21) Appl. No.: 18/965,402

(22) Filed: Dec. 2, 2024

(65) Prior Publication Data

US 2025/0162013 A1 May 22, 2025

Related U.S. Application Data

(63) Continuation of application No. PCT/IN2024/051830, filed on Sep. 23, 2024.

(30) Foreign Application Priority Data

Nov. 17, 2023 (IN) ..... 202321078368

(51) Int. Cl.
*B21C 1/02* (2006.01)
*C22C 18/00* (2006.01)

(52) U.S. Cl.
CPC ..... *B21C 1/02* (2013.01); *C22C 18/00* (2013.01)

(58) Field of Classification Search
CPC ..... B21C 1/02; C22C 18/00; C22F 1/165; B22D 7/00; Y10T 428/12792; B23K 35/362
See application file for complete search history.

(56) References Cited

U.S. PATENT DOCUMENTS 5,522,951 A * 6/1996 Chen ..... C22F 1/165 72/286
8,628,860 B2 1/2014 Refke et al.

FOREIGN PATENT DOCUMENTS

| | | | |
|---|---|---|---|
| CN | 101342548 | A | 1/2009 |
| CN | 102653831 | A | 9/2012 |
| CN | 114262820 | A | 4/2022 |
| CN | 114643297 | A | 6/2022 |
| KR | 100859582 | B1 | 9/2008 |
| PL | 145153 | B1 | 8/1988 |

* cited by examiner

*Primary Examiner* — Lee A Holly
(74) *Attorney, Agent, or Firm* — Maschoff Brennan

(57) ABSTRACT

Disclosed is a method for manufacturing a zinc wire. The method comprises melting a zinc ingot at a first temperature of 420° C. to 650° C. to form a molten zinc. Further, the method comprises calibrating a set of impurities in the molten zinc. Furthermore, the method comprises maintaining the molten zinc at a second temperature between 400° C. to 600° C. Subsequently, the method comprises fluxing the molten zinc to remove a non-metallic impurity. Further, the method comprises transferring the molten zinc into a casting mould to form a cast bar. Furthermore, the method comprises continuously feeding the cast bar from the casting mould to a rolling mill to form a rolled zinc wire rod. Finally, the method comprises drawing a zinc wire rod from the rolled zinc wire rod.

10 Claims, 3 Drawing Sheets

MANUFACTURING ZINC WIRE

PRIORITY INFORMATION

The present application claims a priority from Indian Patent Application No. 202321078368 dated Nov. 17, 2023.

TECHNICAL FIELD

The present subject matter described herein, in general, relates to a zinc wire. More particularly, the disclosure relates to a method for manufacturing the zinc spray wire.

BACKGROUND

Generally, metallurgical methods are complex processes that involve extensive use of metal raw materials. The metallurgical processes incur tremendous losses at the industrial level if the quality of metallic components is poor. Over recent years, there has been an increased need to develop higher-quality metallic components for better performance, minimizing wastage, and reducing costs associated with metal spraying. Metal loss during thermal spray coating is an inherent property of the metal coating process. Additionally, inherent flaws such as porosity, scratch resistance, and adhesion to the base metal limit the feasibility of value engineering to reduce the thickness of such coatings. Therefore, there is a requirement to overcome the shortcomings of conventional thermal spray coatings by developing high-performance spray wires and, consequently, methods to manufacture them.

SUMMARY

Before the present method(s), are described, it is to be understood that this application is not limited to the particular methodologies described, as there can be multiple possible embodiments which are not expressly illustrated in the present disclosure. It is also to be understood that the terminology used in the description is for the purpose of describing the particular implementations or versions or embodiments only and is not intended to limit the scope of the present application. This summary is provided to introduce aspects related to a method for manufacturing a zinc wire. This summary is not intended to identify essential features of the claimed subject matter nor is it intended for use in determining or limiting the scope of the claimed subject matter.

In one implementation, a method for manufacturing a zinc wire is disclosed. Initially a zinc ingot may be melted at a first temperature of 420° C. to 650° C. for a first period of 2 to 4 hours to form a molten zinc. It may be understood that the purity of the zinc ingot is more than 99.995% (w/w). Further, a set of impurities may be calibrated to a concentration between 0.001% to 0.005% (w/w) in the molten zinc. The set of impurities may comprise Pb, Cd, Sn, Fe, Al, Cu, Sr, Ge, Ti, Ta, As, Mn, Mg, and Ag. Furthermore, the molten zinc may be maintained at a second temperature between 400° C. to 600° C. Subsequently, the molten zinc may be fluxed to remove a non-metallic impurity and the non-metallic impurity may comprise at least an oxide, a dust particle, and an air bubble. Further, the molten zinc may be transferred upon fluxing into a casting mould to form a cast bar at a third temperature of the casting mould between 30° C. to 200° C. Furthermore, the cast bar may be continuously fed from the casting mould to a rolling mill at a fourth temperature of 50° C. to 375° C. to form a rolled zinc wire rod. The temperature during the rolling is 15° C. to 300° C. Finally, a zinc wire rod may be drawn from the rolled zinc wire rod in a predefined stepwise reduction (5% to 25%) manner.

In another implementation, a composition of a zinc wire is disclosed. The zinc wire may comprise zinc as a major component with a 99.975% (w/w) concentration. Further, the zinc wire may comprise X as a minor component. It may be understood that X is one or more of Lead (Pb), Cadmium (Cd), Tin (Sn), Iron (Fe), Aluminium (Al), Copper (Cu), Strontium (Sr), Germanium (Ge), Titanium (Ti), Tantalum (Ta), Arsenic (As), Manganese (Mn), Magnesium (Mg), and Silver (Ag) and wherein a total maximum concentration of the minor component is 0.025% (w/w).

BRIEF DESCRIPTION OF THE DRAWINGS

The foregoing detailed description of embodiments is better understood when read in conjunction with the appended drawings. To illustrate the present subject matter, an example of a construction of the present subject matter is provided as figures; however, the invention is not limited to the specific method for manufacturing a zinc wire, disclosed in the document and the figures.

The present subject matter is described in detail with reference to the accompanying figures. In the figures, the left-most digit(s) of a reference number identifies the figure in which the reference number first appears. The same numbers are used throughout the drawings to refer to various features of the present subject matter.

Figure 1:
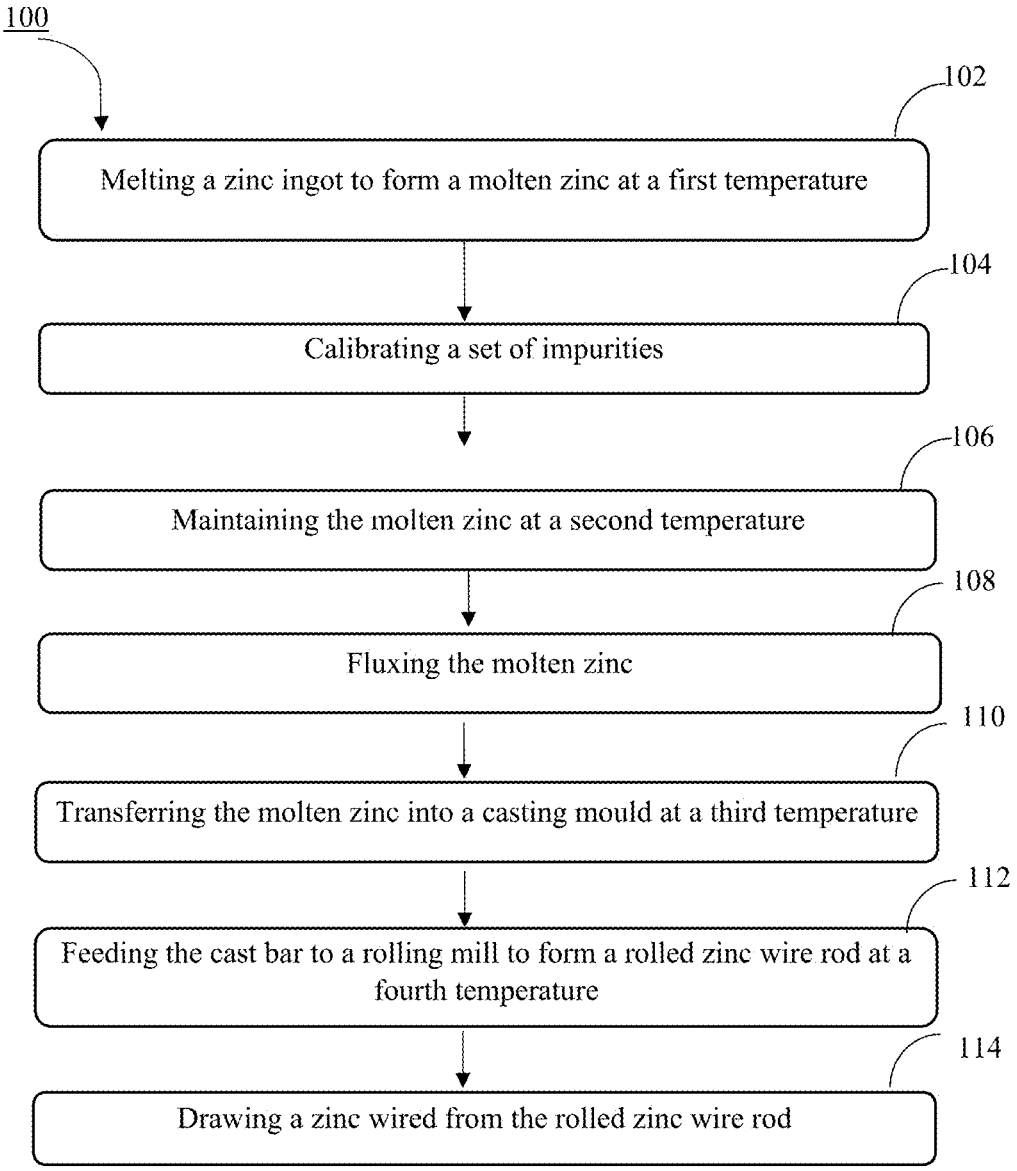
FIG. 1 illustrates a method for manufacturing a zinc wire, in accordance with an embodiment of the present subject matter, in accordance with an embodiment of the present subject matter.

The figures depict an embodiment of the present disclosure for purposes of illustration only. One skilled in the art will readily recognize from the following discussion that alternative embodiments of the structures and methods illustrated herein may be employed without departing from the principles of the disclosure described herein.

DETAILED DESCRIPTION

Some embodiments of this disclosure, illustrating all its features, will now be discussed in detail. The words "treating," "digesting, "assessing," and other forms thereof, are intended to be open ended in that an item or items following any one of these words is not meant to be an exhaustive listing of such item or items or meant to be limited to only the listed item or items. It must also be noted that as used herein and in the appended claims, the singular forms "a," "an," and "the" include plural references unless the context clearly dictates otherwise. Although any methods similar or equivalent to those described herein can be used in the practice or testing of embodiments of the present disclosure, the exemplary, methods are now described. The disclosed embodiments are merely examples of the disclosure, which may be embodied in various forms.

Various modifications to the embodiment will be readily apparent to those skilled in the art and the generic principles herein may be applied to other embodiments. However, one of ordinary skill in the art will readily recognize that the present disclosure is not intended to be limited to the embodiments described but is to be accorded the widest scope consistent with the principles and features described herein.

In recent times, there has been a huge demand for high quality and pure metallic wires for elements like zinc. Zinc has widespread applications in metallic industry. One of the major applications of zinc is in spraying industry. Reason being, zinc's excellent corrosion resistance leading to zinc being used as a protective coating on many products. Metallic and non-metallic products sprayed with zinc can withstand weather extremities. zinc wires is sprayed to form a conductive layer on the non-metallic materials as well. Since zinc has an ability to form thick, adherent corrosion by-products the demand for zinc wire for spraying on objects is only increasing exponentially. The spray coating of zinc can happen in a portable arrangement or in a static workstation as well. However, there are certain drawbacks in the conventional processes and zinc products being used currently which result in technical challenges. Therefore, a need for developing an alternative zinc product with utmost efficiency, and minimum wastage. The present invention aims to overcome the limitations of conventional products of zinc and conventional methods for manufacturing the products with drawbacks as discussed above.

In such attempts, one of the primary objectives may be to manufacture a zinc wire for spraying with an efficiency to reduce dust formation during spraying.

While developing a zinc manufacturing process, and composition thereof, a range of concentrations of the reactants and a range of temperature, pressure, have been tested to implement optimal reaction conditions with optimal concentrations to gain maximum efficiency. The goal of the invention has been to produce a higher efficiency zinc wire along with high quality spray properties in terms of porosity, adhesion, surface roughness, and hardness of the zinc wire.

The present invention provides a method to manufacture a zinc wire and a composition of the same. The zinc wire disclosed is commercially favourable and has been arrived at after multiple variations in the reactant compositions and the reaction conditions. Further, the zinc wire may be understood to exhibit a stable, fine structured, high adsorption efficiency zinc wire for application purpose. In one example, the said zinc wire may also be shaped as a zinc rod. The zinc wire may be sprayed with better spray efficiency resulting in a significantly less dust formation thereby forming a cost effective and efficient spray material. The zinc wire may be derived from zinc as a major component, and lead, copper, iron, aluminium, tin and cadmium as minor components in specific concentrations.

The zinc wire may be manufactured using a zinc ingot. It may be understood that the purity of the zinc ingot is more than 99.995% (w/w). In one aspect, the zinc ingot may be melted at a first temperature of 420° C. to 600° C. to form a molten zinc for a first period of 1 to 3 hours.

Further, a set of impurities may be calibrated to a concentration between 0.001% to 0.005% (w/w) in the molten zinc. The set of impurities may comprise Lead (Pb), Cadmium (Cd), Tin (Sn), Iron (Fe), Aluminium (Al), Copper (Cu), Strontium (Sr), Germanium (Ge), Titanium (Ti), Tantalum (Ta), Arsenic (As), Manganese (Mn), Magnesium (Mg), and Silver (Ag). Furthermore, the molten zinc may be maintained at a second temperature between 400° C. to 600° C. Subsequently, the molten zinc may be fluxed to remove a non-metallic impurity. The non-metallic impurity may comprise at least an oxide, a dust particle, and an air bubble.

Further, the molten zinc may be transferred upon fluxing into a casting mould to form a cast bar at a third temperature of the casting mould between 30° C. to 200° C. Furthermore, the cast bar may be continuously fed from the casting mould to a rolling mill at a fourth temperature of 15° C. to 30° C. to form a rolled zinc wire rod. The temperature during the rolling may be between 50° C. and 375° C. Finally, a zinc wire may be drawn from the rolled zinc wire rod in a predefined stepwise reduction (5% to 25%) manner.

In one aspect, a composition of a zinc wire may comprise zinc as a major component with a 99.975% (w/w) concentration; and X as a minor component, wherein X is one or more of lead, copper, iron, aluminium, tin, and cadmium, and wherein a total maximum concentration of the minor component is 0.025% (w/w).

It may be understood that the composition of the zinc wire may be characterized by lead as the minor component in 0.0002% (w/w) to 0.0010% (w/w) concentration; copper as the minor component in 0.0001% (w/w) to 0.0005% (w/w) concentration; iron as the minor component in 0.0005% (w/w) to 0.0012% (w/w) concentration; aluminium as the minor component in 0.0001% (w/w) to 0.0005% (w/w) concentration; tin as the minor component in 0.0001% (w/w) to 0.0005% (w/w) concentration; and cadmium as the minor component in 0.0001% (w/w) to 0.0005% (w/w) concentration.

While aspects of described method for manufacturing the zinc wire may be implemented in any number of different chemical reactant systems, environments, and/or compositions, the embodiments are described in the context of the following exemplary system.

The present disclosure does not use any harmful reactants, and does not produce any harmful effluents, intermediates and by-products thereby reducing the requirement for effluent treatment.

The present disclosure is principally based on the interactions between zinc as the major component and one or more minor components and the minor components may include, but not be limited to, Lead (Pb), Cadmium (Cd), Tin (Sn), Iron (Fe), Aluminium (Al), Copper (Cu), Strontium (Sr), Germanium (Ge), Titanium (Ti), Tantalum (Ta), Arsenic (As), Manganese (Mn), Magnesium (Mg), and Silver (Ag). It may be understood that different variations of reactants and reaction conditions may be followed before arriving at an optimal reaction. Similarly, the minor components may be tested in various permutations and combinations to identify best yielding combinations.

In an example, and not by way of any limitation, the zinc wire may be manufactured by melting a zinc ingot to form molten zinc at a first temperature ranging from 500° C. to 550° C. for a first period of 2 hours. Further, calibrating a set of impurities to a concentration between 0.001% to 0.005% (w/w) in the molten zinc. In the example, the set of impurities may comprise Lead (0.001%), Strontium (0.0008%), Iron (0.001%), Titanium (0.0008%), and Cadmium (0.0002%). The remaining impurities may collectively amount to 0.012%. Further, the molten zinc may be maintained at a second temperature between 420° C. to 600° C. Furthermore, the molten zinc may be fluxed to remove a non-metallic impurity wherein the non-metallic impurity comprises at least an oxide, a dust particle, and an air bubble. The molten zinc, upon fluxing, may be transferred into a casting mould to form a cast bar between a third temperature of 30° C. and 200° C. Further, the cast bar from the casting mould may be fed to a rolling mill at a fourth temperature of 15° C. to 300° C. to form a rolled zinc wire rod. The temperature during the rolling may be 50° C. to 375° C. Finally, a zinc wire may be drawn from the rolled zinc wire rod in a predefined stepwise reduction (5% to 25%) manner.

Referring now to FIG. 1, a method 100 for manufacturing a zinc wire is disclosed in accordance with an embodiment of the present subject matter. The order in which the method 100 is described is not intended to be construed as a limitation, and any number of the described method-blocks can be combined in any order to implement the method 100 or alternate methods for manufacturing a zinc wire.

Additionally, individual blocks may be deleted from the method 100 without departing from the scope of the subject matter described herein. Furthermore, the method 100 for manufacturing a zinc wire can be implemented with any suitable chemical reactants, alternatives of the reactants or combination thereof. The method 100 may be carried out in a furnace. The furnace may be any suitable furnace like cupola furnace, open hearth furnace, crucible melting, rotary furnace, a reverberatory furnace, and a muffle furnace. However, for ease of explanation, in the embodiments described below the method 100 may be considered to be implemented as described in the method 100 for manufacturing the zinc wire.

At block 102, a zinc ingot may be melted at a first temperature of 420° C. to 600° C. for a first period of 1 to 3 hours. It may be noted that a purity of the zinc ingot is more than 99.995% (w/w). The zinc ingot may be understood as a pure zinc metal structure cast into the shape of a slab, a block, or a rectangular bar for ease of transportation and storage. The zinc ingot may be produced using a solid-state crystallization, a zinc smelting process, and an ultra-high purification process such as sublimation or electrolysis. It may be understood that the purity of the zinc ingot may be tested before choosing the zinc ingots for manufacturing the zinc wire.

Further, the purity of the zinc ingots used in the present method is at least 99.995% or more. In one example, the first temperature may be 500° C. and the first period may be 3 hours. In other example, the first temperature may be 650° C. and the first period may be 2 hours.

It may be understood that the melting of the zinc ingot is a crucial step as a most common source of coating porosity is non-melted zinc particles or grain. Further, melting the zinc ingot to the molten zinc at the first temperature make flow of the molten zinc easier and fills up most of void spaces, thereby reducing the porosity of the zinc wire to be manufactured in subsequent steps. Therefore, the method 100 may utilize the first temperature to melt the zinc ingot to ensure optimal fluidity and prevent the formation of voids or intragranular spaces during the casting of zinc.

Further, it may also be understood that the zinc wire manufactured using method 100 may exhibit higher efficiency due to less porosity resulting in a high corrosion resistance. Hence, the zinc wire manufactured through the method 100 may be used in spraying to form an anti-corrosive coating on a metallic and a non-metallic objects with high corrosion resistance. In one embodiment of the present invention, the zinc wire manufactured using the method 100 is compliant with an International Organization for Standardization's standard named as: IS 12447-1988 (ISO standard).

At block 104, a set of impurities may be calibrated to a concentration between 0.001% to 0.005% (w/w) in the molten zinc. The set of impurities may comprise Pb, Cd, Sn, Fe, Al, Cu, Sr, Ge, Ti, Ta, As, Mn, Mg, and Ag. It may be understood that calibration of the set of impurities may involve removal and addition of the set of impurities to keep the concentration of the set of impurities between a minimum of 0.001% to a maximum of 0.005% (w/w) concentration in the molten zinc.

Further, during calibration the concentrations of each impurity in the set of impurities may be adjusted to achieve a total concentration of the set of impurities between 0.001% to 0.005% (w/w) in the molten zinc. Further, the calibration may involve a removal process to remove excessive amounts of the set of impurities wherein the removal method may comprise an electrolytic refining method, a purification method, or a precipitation method to remove or to reduce the amount of the set of impurities in the molten zinc. Alternatively, the calibration process may involve the addition of favourable impurities. Such calibration of impurities is crucial for producing zinc wire with superior spray properties, enhancing the performance through improved refusion and remelting characteristics during the spraying process.

In one example, the following set of impurities may be used as mentioned in Table 1 below:

TABLE 1

| Name of Element | Concentration Range [in Percentage (%)] |
|---|---|
| Strontium | 0.0001 to 0.0050 |
| Zirconium | 0.0001 to 0.0050 |
| Titanium | 0.0001 to 0.0050 |
| Yttrium | 0.0001 to 0.0050 |
| Chromium | 0.0001 to 0.0050 |
| Nickel | 0.0001 to 0.0050 |
| Germanium | 0.0001 to 0.0050 |

At block 106, the molten zinc may be maintained at a second temperature between 400° C. to 600° C. in the furnace. It may be understood that the second temperature is optimized such that the molten zinc does not undergo solidification and continues to exist in molten zinc form to continue with further method of manufacturing the zinc wire.

At block 108, the molten zinc may be fluxed to remove a non-metallic impurity. The non-metallic impurity may comprise at least an oxide, a dust particle, and an air bubble. It may be understood that fluxing is required to maintain a purity of the molten zinc and any structural inconsistency thereof. The fluxing may be carried out using a substance called as a flux or a fluxing agent. Further, the flux may be understood as a substance promoting fluidity and removing the non-metallic impurities from the molten zinc. The flux may be a strong reducing agent, an organic or inorganic chemical. In one example, the flux may be limestone, silica, fluorite, dolomite, and the like. In another example, the flux may be a metal halide, a carboxylic acid.

At block 110, the molten zinc may be transferred into a casting mould to form a cast bar. A third temperature of the casting mould may be maintained between 30° C. to 200° C.

At block 112, the cast bar from the casting mould may be fed to a rolling mill at a fourth temperature of 15° C. to 300° C. to form a rolled zinc wire rod, wherein the temperature during the rolling is 50° C. to 375° C.

At block 114, a zinc wire may be drawn from the rolled zinc wire rod in a predefined stepwise reduction (5% to 25%) manner. The predefined stepwise reduction may be understood as a gradual reduction from the rolled zinc wire rod to the zinc wire.

Further, the zinc wires manufactured through the method 100 demonstrate an efficient spray material of a high quality and a low cost for film capacitors and also good spray material for corrosion protection of steel structure in petrochemical industry, LPG cylinders, water conservancy, power transmission, windmills, food industry, water supply and bridges.

It may be understood that microstructural changes in a grain structure of the zinc wire are brought about by the method 100. Consequently, the present method 100 improves sprayed surfaces characteristics of any surface sprayed with the zinc wire because of change in microstructural changes. In one embodiment, a scratch resistance property is improved.

Figure 2:
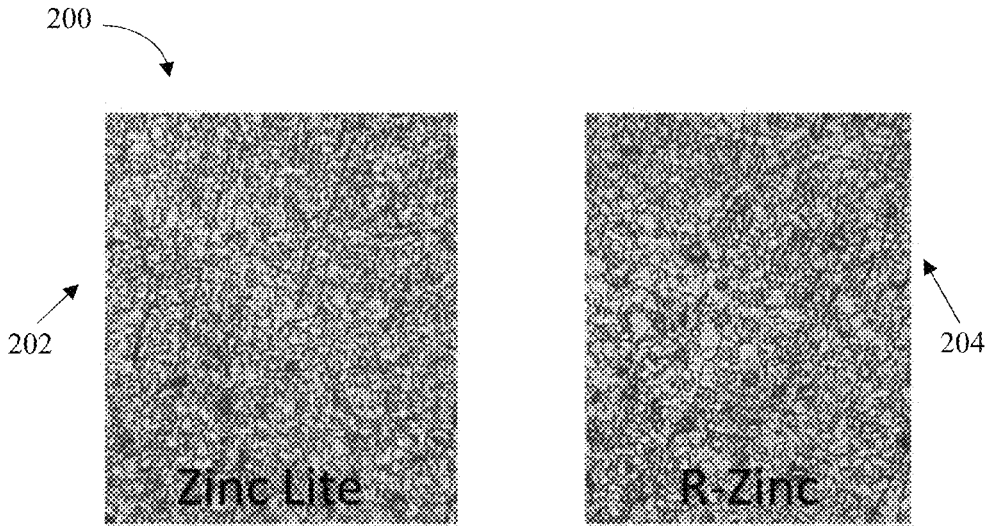
FIG. 2 illustrates an exemplary embodiment in accordance with the present subject matter.

Further, a microstructure of the zinc wire (labelled as 'Zinc-lite') drawn from the method 100 may be differentiated from a microstructure of a regular zinc (labelled as 'R-Zinc') as shown in the FIG. 2.

Referring now to FIG. 2, an exemplary Scanning Electron Microscopic image of two different types of microstructures of zinc particles is shown. As illustrated, the microstructure of the zinc wire (also termed as zinc-lite wire) manufactured using the method 100 as mentioned above is 202, whereas 204 is the microstructure of the regular zinc manufactured using a conventional method different from the method 100. In one embodiment of the present invention a microscopic analysis of the zinc-lite wire resulted in observations as demonstrated in 202. Therefore, the microscopic analysis of the microstructure proves that the zinc-lite wire manufactured using method 100 provides fine atomization and less porosity as compared to regular zinc manufactured using the conventional method. Further, less porosity of the zinc-lite wire increases a coating quality when the zinc-lite wire is sprayed on any object. Less porosity of the zinc-lite wire makes the coating stronger and more durable. Further, an anticorrosive property of the coating also increases due to less porosity of the zinc-lite wire.

Figure 3:
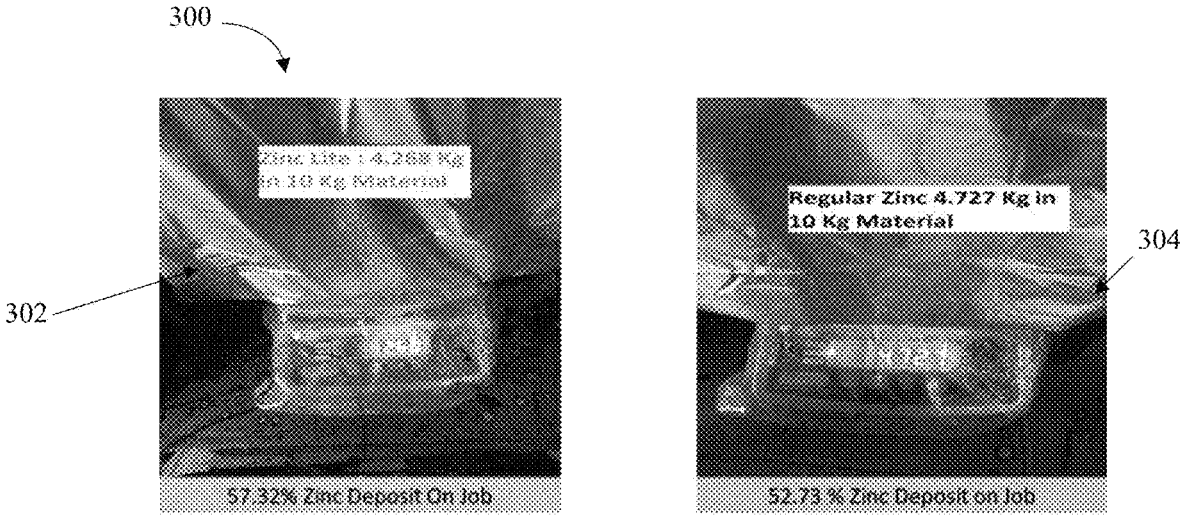
FIG. 3 illustrates an exemplary embodiment in accordance with the present subject matter.

Referring now to FIG. 3, an exemplary result for zinc dust collection 300 using a weighing machine in accordance with the present disclosure is illustrated. It may be noted that a zinc dust 302 of 4.268 kg was collected while spraying 10 kg of the zinc wire manufactured using the method 100 on a job. The job may be understood as an object. In one example, the object may be metallic. In yet another example, the object may be non-metallic. Further, a zinc dust 304 of 4.727 kg was collected while spraying 10 kg of a regular zinc wire manufactured using a conventional method other than the method 100. It may be understood that the zinc wire manufactured using the method 100 provided an efficiency of 57.23% of a zinc deposit on the job with the zinc dust of 4.268 kg per 10 kg of the zinc wire. Whereas the regular zinc wire manufactured using the conventional method provided an efficiency of 52.73% of a zinc deposit on the other job with the regular zinc dust of 4.727 kg per 10 kg of the regular zinc wire.

EXPERIMENTS AND RESULTS

Example 1

In order to explain the method for manufacturing the zinc wire in more detail, consider below experiments performed with zinc as a major component and one or more minor components selected from lead, copper, iron, aluminium, tin, and cadmium as an exemplary embodiment in accordance with the present subject matter. Different minor components in varying proportions may be used in the method. In present example, the zinc is used a major component with a 99.975% (w/w) concentration.

Further, the zinc may be obtained in form of a zinc ingot. Initially, in a closed furnace, the zinc ingot is melted at a first temperature of 480° C. for a first period of 3 hours. Upon melting, the zinc ingot is converted to a molten zinc. It may be understood that the purity of the zinc ingot is 99.996%. Subsequently, a set of impurities is calibrated to a concentration of 0.004% (w/w) and the set of impurities may comprise Pb, Cd, Sn, Fe, Al, Cu, Sr, Ge, Ti, Ta, As, Mn, Mg, and Ag. Particularly in the present example, the set of impurities is calibrated using Pb and Cd of concentration of 0.002% each, summing up to a concentration of the set of impurities as 0.004% for Pb and Cd.

Further, the molten zinc is maintained at 500° C. In the next step, the molten zinc may be fluxed to remove non-metallic impurities. In the present example, the metallic impurity fluxed is a dust particle and an oxide with a few air bubbles. Furthermore, the molten zinc is transferred into a casting mould to form a cast bar. The cast mould is preheated to a temperature of 150° C.

Subsequently, the cast bar is continuously fed from the casting mould to a rolling mill at a fourth temperature of 250° C. to form a rolled zinc wire rod. The temperature during rolling of the cast bar to form a rolled zinc wire rod is maintained at 300° C. Finally, a zinc wire is drawn from the rolled zinc wire rod in a predefined stepwise reduction manner from 5% to 25%.

Example 2

In one exemplary embodiment, a zinc wire manufactured through the method 100 named as a zinc-lite wire is used for spraying a first steel cylinder. Further a regular zinc wire manufactured through a conventional method other than the method 100 is also used for spraying a second steel cylinder. It may be important to note that the first steel cylinder and the second steel cylinder are completely identical in terms of physical dimensions (height, weight, volume) and conditions of spraying the zinc-lite wire and the regular zinc wire are also kept same, such as weight of each of the wire used in spraying is 10 kg. Further, the spraying apparatus and the spraying conditions maintained are also kept same while spraying the zinc-lite wire and the regular zinc wire. Further, four tests are carried out for the first steel cylinder and the second steel cylinder. The four tests are namely: Micro Vickers Hardness Test (HV0.3), Area Percentage Porosity Test, Bond Adhesion Strength Test (psi), and Surface Roughness as Sprayed (Ra) Test. Upon performing the four tests, following test results were obtained for the zinc-lite wire and the regular zinc wire as mentioned in Table 2 below:

TABLE 2

Test Results Comparison between Regular Zinc Wire & Zinc-lite Wire

| Test Method and Condition | Regular Zinc Wire | Zinc-Lite Wire |
|---|---|---|
| Micro Vickers Hardness Test (HV0.3)<br>Test reference: ASTM E 384-2017<br>Test Force: HV0.3<br>Dwell time: 10 Second<br>(Average of 3 Reading) | 20.80 | 21.13 |
| Area Percentage Porosity Test<br>Test Method: ASTM E 2109-01(Method B)<br>Total Magnifying Power: 200×<br>Sample Polished area: 24 mm of coating length | 3.64% | 2.86% |
| Bond Adhesion Strength Test (psi)<br>Test Method: ASTM C633-2017 | 4832.25 | 5796.42 |
| Surface Roughness as Sprayed (Ra) Test<br>(Average of 3 Reading) | 4.87 μm | 4.74 μm |

It may be easily understood from Table 2 that the zinc-lite wire manufactured using method 100 is certainly superior to the regular zinc wire in all aspects.

Example 3

In one exemplary embodiment of the present subject matter, a zinc wire is manufactured using the method 100 (also termed as zinc-lite wire) and a regular zinc wire is manufactured using a conventional method other than the method 100. Further, the zinc-lite wire and the regular zinc wire are tested on four testing parameters namely: Adhesion Test, Porosity Test, Roughness Test, and Deposition Percentage (%) Test, wherein all four tests were carried out using standard protocols well known in the state of art. Following results were obtained for the testing parameters of the zinc-lite wire and the regular zinc wire as mentioned in Table 3 below:

TABLE 3

| Sr. No. | Testing Parameter | Regular Zinc Wire | Zinc-lite Wire |
|---|---|---|---|
| 1 | Adhesion Test | 4865.29 Psi | 5796 Psi |
| 2 | Porosity Test | 3.64% | 2.86% |
| 3 | Roughness Test | 4.87 | 4.74 |
| 4 | Deposition Efficiency % | 52.73% | 57.32% |

It may be easily understood from table 3, that the zinc-lite wire manufactured using the method 100 is certainly efficient than the regular zinc wire in all aspects.

Exemplary embodiments discussed above may provide certain advantages. Though not required to practice aspects of the disclosure, these advantages may include those provided by the following features.

Some embodiments of the method provide a zinc wire resulting in 5-7% decreased formation of zinc dust during spraying of the zinc wire, thereby increasing the efficiency of the zinc spraying process.

Some embodiments of the method provide a zinc wire for metal spraying to prevent corrosion of metallic and non-metallic objects.

Some embodiments of the method provide a zinc wire with stability and fine atomization with reduced pore size.

Some embodiments of the method provide a zinc wire with high quality, lesser porosity, and high adhesion capacity as compared to any conventional method or product thereby.

Some embodiments of the method provide a zinc wire with an optimized proportion of the set of impurities and the minor components.

Although implementations for manufacturing a zinc wire have been described in language specific to structural features and/or methods, it is to be understood that the appended claims are not necessarily limited to the specific features or methods described. Rather, the specific features and methods are disclosed as examples of implementations for manufacturing a zinc wire.

The invention claimed is:

1. A method for manufacturing a zinc wire, the method comprising:

melting a zinc ingot to form a molten zinc at a first temperature of 420° C. to 650° C. for a first period of 1 to 3 hours, wherein a purity of the zinc ingot is more than 99.995% (w/w);

calibrating a set of impurities to a concentration between 0.001% to 0.005% (w/w) in the molten zinc, wherein the set of impurities comprise at least one of Lead (Pb), Cadmium (Cd), Tin (Sn), Iron (Fe), Aluminum (Al), Copper (Cu), Strontium (Sr), Germanium (Ge), Titanium (Ti), Tantalum (Ta), Arsenic (As), Manganese (Mn), Magnesium (Mg), and Silver (Ag);

maintaining the molten zinc at a second temperature between 420° C. to 600° C.;

fluxing the molten zinc to remove a non-metallic impurity wherein the non-metallic impurity comprises at least an oxide, a dust particle, and an air bubble;

transferring the molten zinc upon fluxing into a casting mould to form a cast bar, wherein a third temperature of the casting mould is 30° C. to 200° C.;

feeding the cast bar from the casting mould to a rolling mill at a fourth temperature of 15° C. to 300° C. to form a rolled zinc wire rod, wherein the temperature during the rolling is 50° C. to 375° C.; and drawing a zinc wire from the rolled zinc wire rod in a predefined stepwise reduction (5% to 25%) manner.

2. The method as claimed in 1, further comprises spraying the zinc wire through a spraying apparatus on a surface of an object, wherein a diameter of the zinc wire is 0.60 mm to 6 mm.

3. The method as claimed in claim 2, wherein the spraying apparatus comprises a spraying gun, a spraying console, a feedstock, and a spraying gas, wherein the feedstock comprises the zinc wire, and wherein the spraying gas is argon, propane, and helium.

4. The method as claimed in claim 2, wherein the spraying is performed in a thermal spray mode, a flame spray mode and an arc spray mode.

5. The method as claimed in claim 2, wherein the object is made of a metallic substance and a non-metallic substance.

6. The method as claimed in claim 1, wherein the zinc wire is drawn from the rolled zinc wire rod with a controlled lubrication and a controlled percentage reduction limit wherein the percentage of reduction is 5% to 25%.

7. The method as claimed in claim 1, wherein the drawing comprises a cold wire drawing technique to draw the zinc wire from the rolled zinc wire rod, wherein the diameter of the zinc wire is 0.60 mm to 6.00 mm, and wherein the zinc wire is stored in a coil form.

8. The method as claimed in claim 1, wherein the rolling comprises a hot rolling technique to reduce the zinc bar to wire-rod, and wherein the diameter of the zinc wire-rod is 4.00 mm to 6.00 mm, and wherein the zinc wire-rod is stored in a coil form.

9. The method as claimed in claim 1, wherein the zinc wire is characterized by an area porosity of 2.86%, a bond adhesion strength of 5796.42 psi, and a surface roughness of 4.74 μm.

10. The method as claimed in claim 1, wherein the spraying is characterized by a deposition efficiency of 4% to 10% per 10 kg of the zinc wire.

* * * * *